US009865418B2

(12) United States Patent
Yang

(10) Patent No.: US 9,865,418 B2
(45) Date of Patent: Jan. 9, 2018

(54) CIRCUIT BREAKERS, ARC EXPANSION CHAMBERS, AND OPERATING METHODS

(71) Applicant: Siemens Industry, Inc., Alpharetta, GA (US)

(72) Inventor: Guang Yang, Suwanee, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 14/962,205

(22) Filed: Dec. 8, 2015

(65) Prior Publication Data

US 2017/0162350 A1 Jun. 8, 2017

(51) Int. Cl.

| | |
|---|---|
| ***H01H 33/91*** | (2006.01) |
| ***H01H 33/10*** | (2006.01) |
| ***H01H 33/73*** | (2006.01) |
| ***H01H 33/82*** | (2006.01) |
| ***H01H 33/90*** | (2006.01) |
| ***H01H 9/34*** | (2006.01) |
| ***H01H 71/24*** | (2006.01) |

(52) U.S. Cl.

CPC ..... *H01H 33/91* (2013.01); *H01H 9/342* (2013.01); *H01H 33/10* (2013.01); *H01H 33/73* (2013.01); *H01H 33/82* (2013.01); *H01H 2009/343* (2013.01); *H01H 2009/348* (2013.01); *H01H 2033/908* (2013.01); *H01H 2071/2427* (2013.01)

(58) Field of Classification Search

CPC .... H01H 33/10; H01H 33/08; H01H 33/7015; H01H 33/91; H01H 2033/908

USPC ... 218/66–68, 46–48, 51, 81–82, 86, 88, 90, 218/109

See application file for complete search history.

(56) References Cited

U.S. PATENT DOCUMENTS

| | | | | |
|---|---|---|---|---|
| 3,940,583 A * | 2/1976 | Hertz | H01H 33/901 | 218/66 |
| 3,975,602 A * | 8/1976 | Hertz | H01H 33/901 | 218/66 |
| 5,534,673 A * | 7/1996 | Lehmann | H01H 9/04 | 218/68 |
| 6,207,918 B1 * | 3/2001 | Lorenz | H01H 33/903 | 218/59 |
| 7,820,933 B2 * | 10/2010 | Heiermeier | H01H 33/901 | 218/60 |

(Continued)

FOREIGN PATENT DOCUMENTS

| | | |
|---|---|---|
| CN | 103021750 A | 4/2013 |
| EP | 0455564 A1 | 11/1991 |
| EP | 0538149 A1 | 4/1993 |

OTHER PUBLICATIONS

Siemens U.S. Appl. No. 14/482,024, filed Sep. 10, 2014; Inventor—Guang Yang. (27 pages).

*Primary Examiner* — Renee Leubke
*Assistant Examiner* — William Bolton

(57) ABSTRACT

A circuit breaker having first and second electrical contacts configured to generate an electrical arc upon being separated, an arc chamber surrounding at least a portion of a space between the first and second electric contacts, at least one expansion chamber positioned proximate to the arc chamber, and an arc pressure control valve assembly configured to allow threshold-based flow into and out of the at least one expansion chamber. An arc pressure control valve assembly and method of operating a circuit breaker are described, as are other aspects.

18 Claims, 7 Drawing Sheets

(56) References Cited

U.S. PATENT DOCUMENTS

| | | | | |
|---|---|---|---|---|
| 2009/0261071 | A1* | 10/2009 | Nufer | H01H 33/901 218/81 |
| 2010/0237047 | A1* | 9/2010 | Yang | H01H 9/346 218/149 |
| 2013/0126316 | A1 | 5/2013 | Woodson | |
| 2013/0140275 | A1 | 6/2013 | Shea et al. | |
| 2015/0294820 | A1* | 10/2015 | Kim | H01H 33/90 218/59 |

* cited by examiner

CIRCUIT BREAKERS, ARC EXPANSION CHAMBERS, AND OPERATING METHODS

FIELD

The present invention relates generally to arc chambers for extinguishing arcs, such as in circuit breakers.

BACKGROUND

In general, a circuit breaker operates to engage and disengage a selected electrical circuit from an electrical power supply. The circuit breaker ensures current interruption thereby providing protection to the electrical circuit from continuous over current conditions and high current transients due to, for example, electrical short circuits. Such circuit breakers operate by separating a pair of internal electrical contacts contained within a housing (e.g., molded case) of the circuit breaker. Typically, one electrical contact is stationary while the other is movable (e.g., typically mounted on a pivotable contact arm).

The contact separation may occur manually, such as when a person throws an operating handle of the circuit breaker. This may engage an operating mechanism, which may be coupled to the contact arm and moveable electrical contact. Otherwise, the electrical contacts may be separated automatically when an over current, short circuit, or fault condition is encountered. Automatic tripping may be accomplished by an operating mechanism actuated via a thermal overload element (e.g., a bimetal element) or by a magnetic element, or even by an actuator (e.g., a solenoid).

Upon separation of the electrical contacts by tripping, an intense electrical arc may be formed in than arc chamber containing the electrical contacts. This separation may occur due to heat and/or high current through the circuit breaker or due to sensing a ground or other arc fault. It is desirable to extinguish the arc as quickly as possible to avoid damaging internal components of the circuit breaker.

In low voltage alternating current (AC) circuit breakers, such as molded case circuit breakers (MCCBs), two methods are commonly used to extinguish arcs. The first method is often referred to as current limiting and it includes actively raising the arc voltage to a level higher than the system voltage, which effectively forces the current to reduce to zero. Commonly used current limiting methods include providing arc plates, outgassing material, and designing long arcs. The second method includes using the natural current zero crossing from AC circuit to prevent re-ignition after current goes to zero.

In some currently-available circuit breakers, due the inductance present in a circuit, a recovery voltage can be induced across the arc chamber. If the recovery voltage in the arc chamber is high enough, this can re-ignite the extinguished arc and cause failed or delayed interruptions and additional wear of the contacts and surrounding components.

Accordingly, there is a need for apparatus and methods to rapidly extinguish an electrical arc in a circuit breaker resulting from contact separation.

SUMMARY

According to a first aspect, a circuit breaker is provided. The circuit breaker includes first and second electrical contacts (e.g., stationary and moveable electrical contacts), the electrical contacts configured to generate an electrical arc upon being separated, an arc chamber surrounding at least a portion of a space between the first and second electric contacts, at least one expansion chamber positioned proximate to the arc chamber, and a valve assembly configured to allow threshold-based flow into and out of the at least one expansion chamber.

In accordance with another aspect, an arc pressure control assembly of a circuit breaker is provided. The arc pressure control assembly includes an arc chamber containing first and second electrical contacts, at least one expansion chamber positioned proximate to the arc chamber, and a valve assembly configured to allow threshold-based flow into and out of the at least one expansion chamber.

In accordance with another aspect, a method of operating a circuit breaker is provided. The method includes separating a first electrical contact from a second electrical contact and forming an electrical arc in an arc chamber, flowing gas from the arc chamber into an expansion chamber disposed adjacent to the arc chamber in response to arc-produced rising pressure in the arc chamber, the gas flowing only upon exceeding an inlet threshold pressure, holding gas in the expansion chamber, and flowing gas from the expansion chamber back into the arc chamber in response to a decrease in the pressure in the arc chamber, the gas flowing only upon a pressure in the arc chamber falling below an outlet threshold pressure.

Still other aspects, features, and advantages of the present invention may be readily apparent from the following detailed description by illustrating a number of example embodiments and implementations, including the best mode contemplated for carrying out the present invention.

BRIEF DESCRIPTION OF DRAWINGS

The drawings, described below, are provided for illustrative purposes only and are not necessarily drawn to scale. The drawings are illustrative and not intended to limit the scope of the invention in any way. Wherever possible, the same or like reference numbers will be used throughout the drawings to refer to the same or like parts.

DESCRIPTION

Example embodiments of one or more expansion chambers described herein may be included in a circuit breaker to prevent a re-ignition failure of the circuit breaker. In certain example embodiments, upon contact separation, an arc is formed in the volume inside of an arc chamber of the circuit breaker. The arc, extending between the first and second electrical contacts (e.g., stationary and moveable electrical contacts), produces arcing gases and also heats up and pressurizes the air within the arc chamber. This causes a flow of the heated air and arc gasses, due to the pressure change, into an expansion chamber disposed adjacent to the arc chamber, but only at certain times during the arcing event.

A valve assembly is provided between the arc chamber and the expansion chamber to allow flow into and out of the expansion chamber only at the certain times during the arcing event. For example, the valve assembly may include an inlet valve allowing gas flow only when an inlet threshold pressure in the arc chamber is exceeded. Further, the valve assembly may include an outlet valve allowing gas flow only when a pressure in the arc chamber falls below an outlet threshold pressure.

Thus, gas flows into the expansion chamber after the gas pressure in the arc chamber reaches the inlet threshold pressure, is held in the expansion chamber for part of the arc cycle, and then flows out of the expansion chamber and back into the arc chamber when the pressure in the arc chamber falls below the outlet threshold pressure. This gas flow may cool down the arc chamber and may also increase dielectric strength thereof. In one or more embodiments, the gas flow around the arc increases the arc voltage, thereby providing better current limiting performance.

These and additional embodiments of an arc chamber pressure control assembly, circuit breakers including the arc chamber pressure control assembly, and methods of operating a circuit breaker are provided and fully described with reference to FIGS. 1A through 6 herein.

Figure 1A:
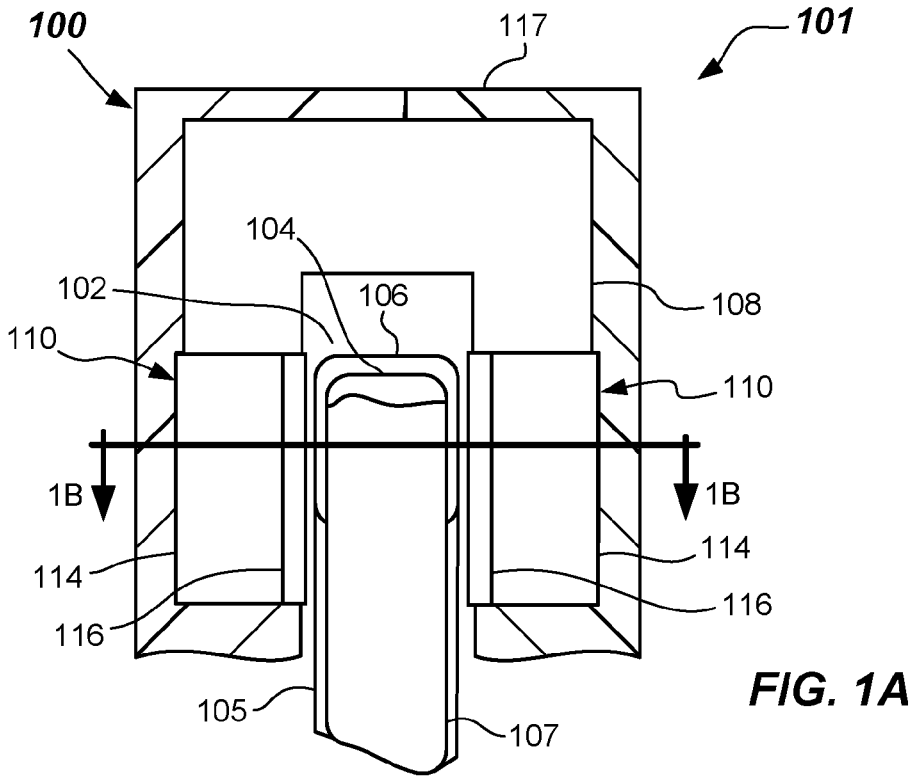
FIGS. 1A and 1B illustrate a top plan view and a cross-sectional front view, respectively, of a circuit breaker including an expansion chamber according to one or more embodiments.
Figure 1B:
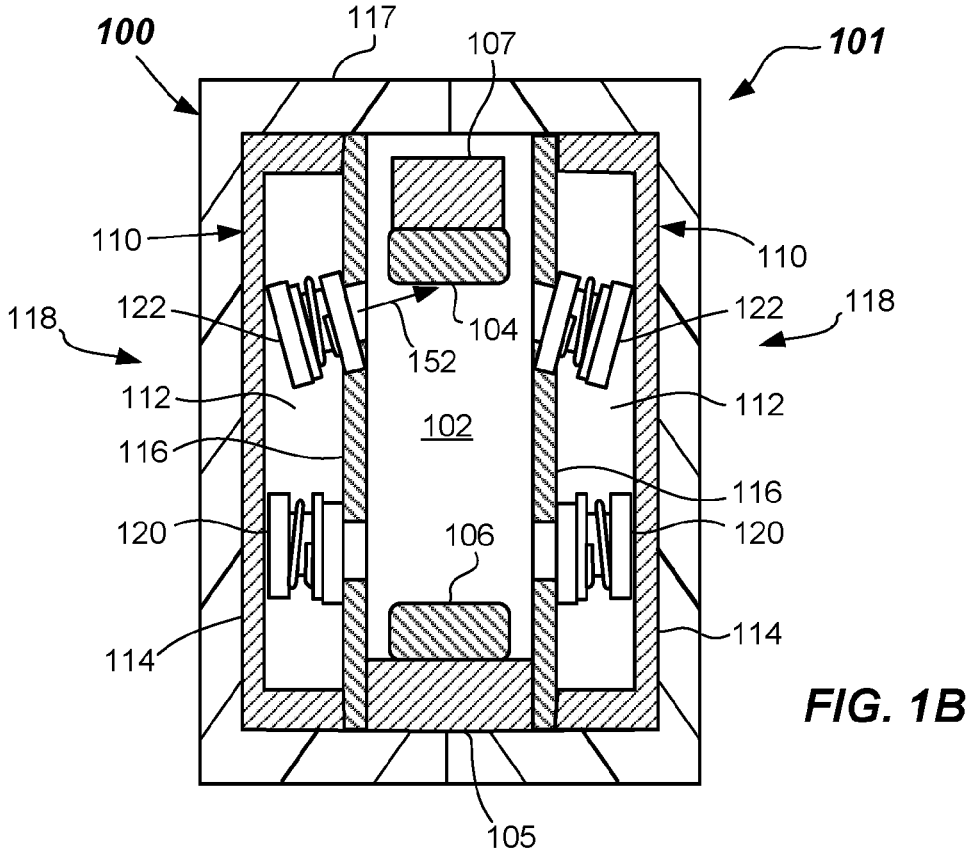

Referring now to FIGS. 1A and 1B, a cross-sectioned top view and a cross-sectioned side view and an arc chamber pressure control assembly 100 of a circuit breaker 101 are shown. As illustrated, the arc chamber pressure control assembly 100 includes an arc chamber 102 in which the arc is formed. The arc chamber 102 encompasses at least a portion of a space between a moveable electrical contact 104 (only a portion shown in FIG. 1A) and a stationary electrical contact 106 (only a portion shown in FIG. 1A), as the stationary electrical contact 106 and moveable electrical contact 104 separate from one another during a tripping event.

Moveable electrical contact 104 may be secured at an end of a contact arm 107 that may be pivotable to move the moveable electrical contact 104 away from the stationary electrical contact 106 during a tripping event. Contact arm 107 may be connected to a load terminal (not shown) via a flexible conductor or the like. The stationary electrical contact 106 may be disposed on a line conductor 105 that may be coupled to a line terminal (not shown). At a forward end of the arc chamber 102, arc plates 108 may be provided. Arc plates 108 may comprise a stack of spaced U-shaped metal arc plates that function to help extinguish the arc. Other shapes than shown may be used.

The arc chamber pressure control assembly 100 may include one or more expansion members 110 each including at least one expansion chamber 112 formed in an internal portion thereof, and positioned proximate to the arc chamber 102, and in the depicted embodiment, two expansion chambers 112 positioned on opposite from one another on opposite sides of the arc chamber 102. Arc plates 108 may be positioned at the forward end of the one or more expansion members 110 and may be truncated. The expansion members 110 may be housed within the molded case 117 and may be secured in place thereby. Molded case 117 may include two or more part construction held together by fasteners (e.g., rivets—not shown).

The expansion members 110 may include a two or more part construction, such as body 114 and cover 116 shown. However, other constructions may be possible. The body 114 may be a part of the molded case 117 in an alternative embodiments. Body 114 and cover 116 may be sealed to one another in some embodiments, such as by adhesive, sonic welding, or other suitable joining means. The arc chamber 102 may be defined by the walls of the covers 116 of the expansion members 110 and by the stationary electrical contact 106 and coupled conductor 105, the molded case 117, and the front edges of the arc plated 108.

In one or more embodiments, the arc chamber pressure control assembly 100 includes an arc pressure control valve assembly 118 operable (capable of being operated) and configured to allow threshold-based flow into and out of the at least one expansion chamber 112. For example, in the embodiment shown, each expansion chamber 112 may include an arc pressure control valve assembly 118 facilitating threshold-based flow into and out of the expansion chambers 112. "Threshold-based flow" as used herein means gas flow into and out of the expansion chamber 112 only occurs once a respective desired threshold pressure level is achieved, i.e., above an inlet threshold pressure and below an outlet pressure threshold to be described fully below.

In particular, as shown in FIGS. 2A-2B and 3A-3B, each arc pressure control valve assembly 118 of each expansion member 112 may include an inlet valve 120 and an outlet valve 122. The inlet valve 120 may be configured to allow the flow of gases (e.g., air and arcing gases) from the arc chamber 102 and into an expansion chamber 112 disposed adjacent to the arc chamber 102 in response to a current rising phase (e.g., current rising phase 427 of FIG. 4) in the electrical arc and an associated rise in pressure within the arc chamber 102. In particular, inlet valve 120 may be configured to allow one-way inflow into the expansion chambers 112.

Figure 4:
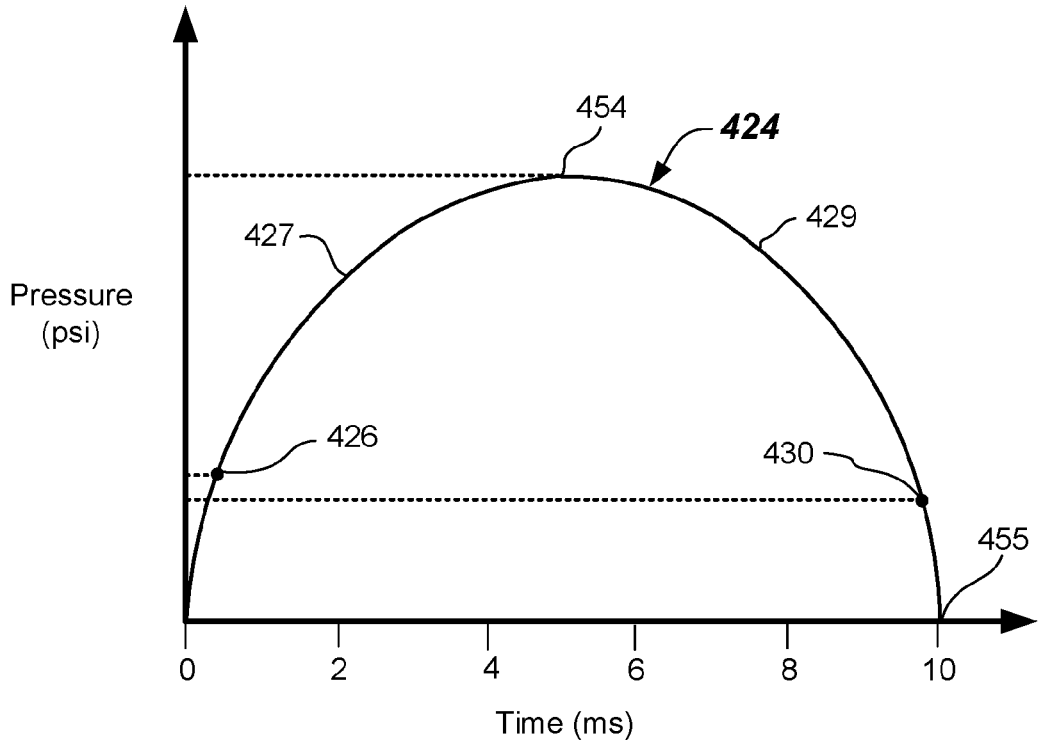
FIG. 4 is a graph illustrating an estimated relationship between pressure and time during an arcing event in a circuit breaker with an expansion chamber in accordance with one or more embodiments.

An example estimated pressure versus time plot 424 of the absolute pressure in the arc chamber 102 is shown in FIG. 4. In accordance with the operation of the invention, the gas flows through the inlet valve 120 only upon exceeding an inlet threshold pressure 426 in the arc chamber 102 during a current rising phase 427 of the arc. The inlet threshold pressure 426 is set by the construction of the inlet valve 120, which may include a pop-off type valve configuration, as is described fully below.

Further, in accordance with the operation of the invention, the gas contained in the expansion chamber 112 may be held during portions of the arc cycle and then flow out of the expansion chamber 112, through the outlet valve 122, and back into the arc chamber 102 in response to an associated decrease in the pressure in the arc chamber 102 during a current falling phase 429. During the current falling phase 429, gas is held in the expansion chamber 112, and the gas may flow from the expansion chamber 112 through the outlet valve 122 only upon the pressure in the arc chamber 102 falling below an outlet threshold pressure 430. The outlet threshold pressure 430 is set by the construction of the outlet valve 122, which may also include a pop-off type valve configuration, as will be described fully below. Thus, the outlet valve 122 may be configured to allow one-way outflow from the expansion chamber 112.

In the depicted embodiments, the inlet valve 120 and outlet valve 122 of the one or more expansion chambers 112 are provided in spaced locations relative to one another (e.g., spaced along a height of the cover 116). In this manner, gas may flow out of the arc chamber 102 closest to the stationary electrical contact 106 and back into the arc chamber 102 at a location closer to the moveable electrical contact 104. In one or more embodiments, the number and locations of the inlet and outlet valves 120, 122 may be varied. Further, a size, location, and number of the one or more expansion chambers 112 may be varied depending on the specifications of the circuit breaker. In some embodiments, an expansion chamber may be located on one or both sides of the arc chamber 102, and/or even below or above the arc chamber 102.

In the depicted embodiments, the expansion members 110 may be molded from a suitable polymer material. The material may be an outgassing material in some embodiments, such as a thermoset material (e.g., a glass-filled polyester), or a thermoplastic material (e.g., a Nylon material). Outgassing materials may outgas gases such as water vapor upon be subjected to arc energy. Other suitable outgassing materials may be used. For example, the cover 116 may be made from an outgassing material, but the body may be a metal, such as steel, so as to function as a slot motor.

Figure 2A:
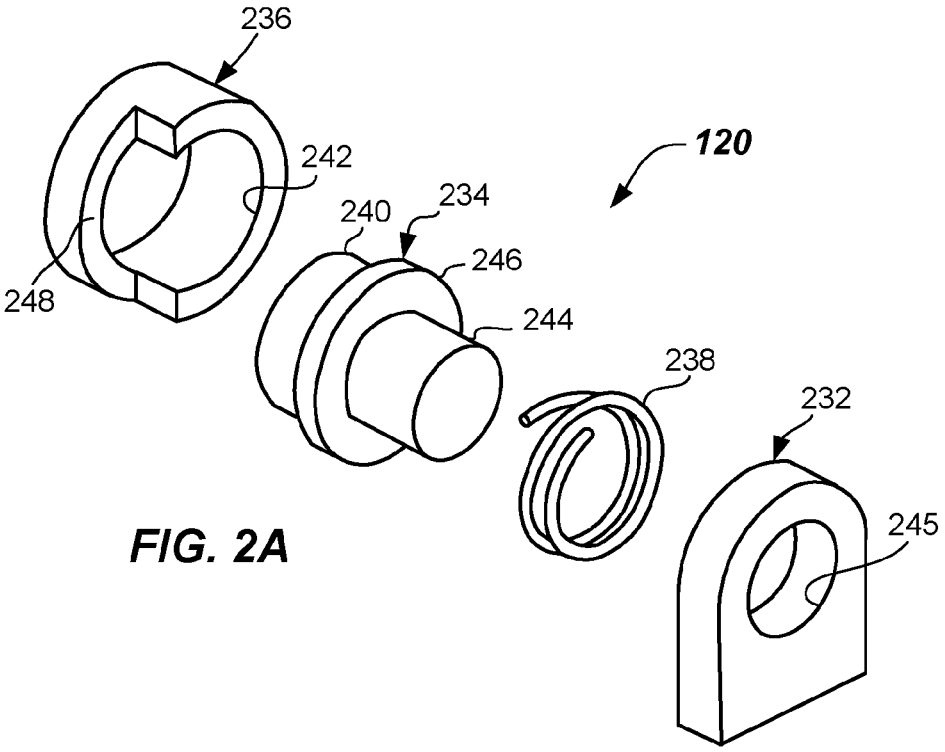
FIG. 2A illustrates an exploded view of components of an inlet valve in accordance with one or more embodiments.
Figure 2B:
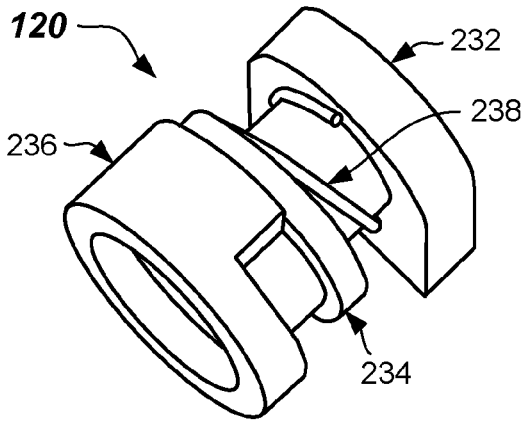
FIG. 2B illustrates an isometric view of an inlet valve in accordance with one or more embodiments.

Referring now to FIGS. 2A and 2B, respective exploded isometric view and an isometric view of the inlet valve 120 of an arc pressure control valve assembly 118 are shown. As illustrated, the inlet valve 120 includes a mount 232, a piston 234, a bearing 236 wherein the piston 234 is configured to move relative to the bearing 236, and a reset spring 238. In the depicted embodiment, the bearing 236 may be fastened to, or integral with, the cover 116 of the expansion member 110. The piston 234 may be moveable relative to the bearing 236 and may include a shaft 240 that includes a closely received sliding fit within an aperture 242 of the bearing 236.

The reset spring 238 may be received over a spring pilot 244 of the piston 234 and may provide a spring force against flange 246 to close the inlet valve 120 via sealing the shaft 240 in the aperture 242, i.e., wherein the reset spring 238 biases the piston 234 to a normally closed position. The spring pilot 244 may be received and supported in the guide 245 formed in the mount 232. The mount 232, piston 234, and bearing 236 may be made from a suitably rigid material such as a polymer. Reset spring 238 may be a coil spring or other suitable type of spring.

Pressure inside the arc chamber 102 acting against the circular end area of the shaft 240 causes the piston 234 to translate in the aperture 242 and against the spring force provided by the reset spring 238. At an inlet threshold pressure 426 that is pre-designed, the shaft 240 moves outwardly beyond the cutout 248 thus allowing gas (e.g., air and arcing gases) to escape and flow from the arc chamber 102 and into the expansion chamber 112. Gas continues to flow into the expansion chamber 112 until the pressure in the expansion chamber 112 is nearly equalizing with the pressure in the arc chamber 102 just before the peak pressure 454. At this point, the force of the reset spring 238 between the mount 232 and the flange 246 recloses the inlet valve 120 by moving the end of the shaft 240 past the cutout 248.

During the entire current rising phase 427 (FIG. 4), the outlet valve 122 may remain closed. Effectively, once the inlet valve 120 opens the expansion chamber 112 begins to pressurize and continues to gain pressure until the equalization occurs and then the inlet valve 120 closes. This stored pressure in the expansion chamber 112 will be held in the expansion chamber 112 for a time to be used later in the arcing cycle as will be apparent from the further description below.

In one or more embodiments, the expansion chamber 112 includes an internal storage volume that is greater than about 500 $mm^3$. For example, an internal storage volume of the expansion chamber 112 may be greater than about 1,000 $mm^3$ for a 600V/250 A circuit breaker, or even greater than about 1,500 $mm^3$ for a 600V/250 A circuit breaker. In some embodiments, the internal storage volume of the expansion chamber 112 may be about 2,000 $mm^3$ or more. In some example embodiments, the expansion chamber 112 may be a rectangular shape and may include an internal height (H) of about 38 mm, an internal width (W) of about 6 mm, and an internal thickness (T) of 6 mm. Other sizes, shapes, and storage volumes for the one or more expansion chambers 112 may be used. Two expansion chambers 112 are shown. However, other numbers of expansion chambers may be used.

In one or more embodiments, a piston area of the shaft 240 of the piston 234 is greater than about 12 $mm^2$. In one or more example embodiments, a diameter of the piston 234 on the end of shaft 240 is about 4.57 mm or about 16.4 $mm^2$ of piston area. The reset spring 238 for the inlet valve 120 may include a spring rate of between about 0.28 N/mm, and about 0.42 N/mm, for example. When the inlet valve 120 is fully opened, a displacement of about 1.25 mm or more may occur. An inlet flow area of the inlet valve 120, when fully opened, may be greater than about 5 $mm^2$, and may be greater than about 6 $mm^2$ in some embodiments. However, as will be appreciated by those of ordinary skill in the art, other diameters, areas of the piston 234, spring rates of the reset spring 238, and inlet flow areas may be used.

Figure 3A:
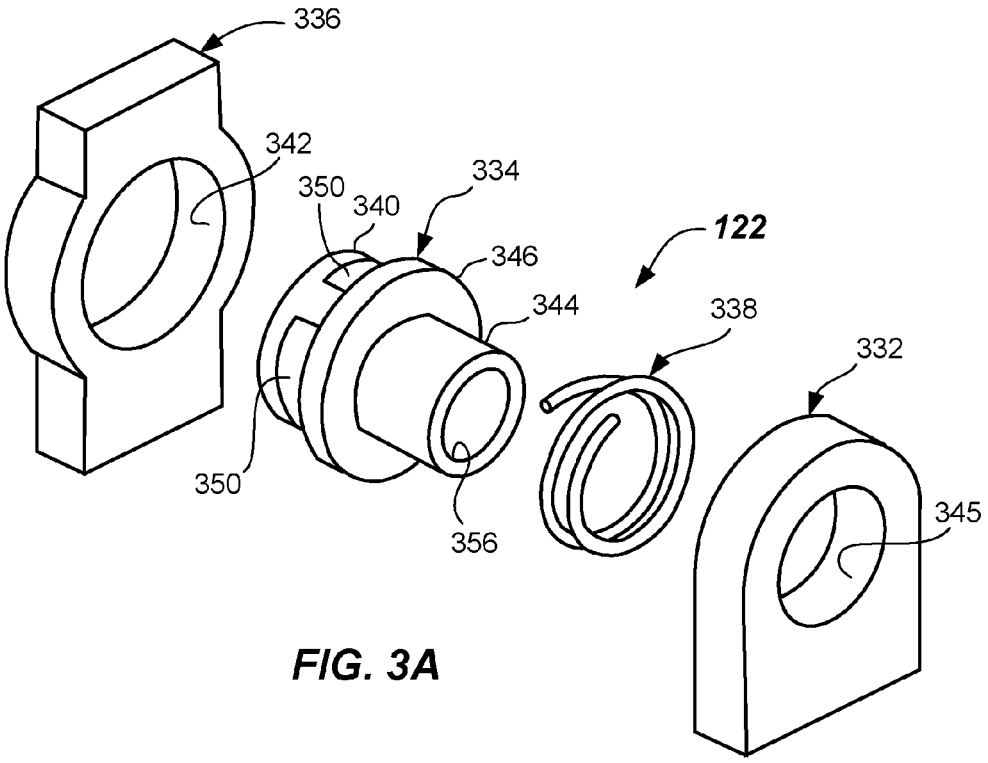
FIG. 3A illustrates an exploded view of components of an outlet valve in accordance with one or more embodiments.
Figure 3B:
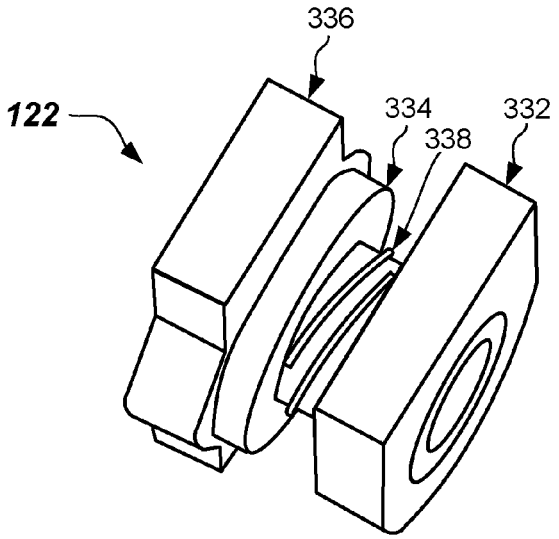
FIG. 3B illustrates an isometric view of an outlet valve in accordance with one or more embodiments.

Referring now to FIGS. 3A and 3B, an example embodiment of an outlet valve 122 is shown. As illustrated, the outlet valve 122 includes a mount 332, a piston 334, a bearing 336 wherein the piston 334 is configured to move relative to the bearing 336, and a reset spring 338. In the depicted embodiment, the bearing 336 may be fastened to, or integral with, the cover 116 of the expansion member 110. The piston 334 may be moveable relative to the bearing 336 and may include a shaft 340 that is closely and slidably received in an aperture 342 of the bearing 336. The reset spring 338 may be received over a spring pilot 344 and may provide a spring force against flange 346 to close the outlet valve 122. Upon closing, the shaft 340 is sealed in the aperture 342, i.e., the reset spring 338 biases the piston 334 to a normally closed position. The spring pilot 344 may be received in a supported by guide 345 formed in mount 332. Mount 332, piston 334, and bearing 336 may be made from a suitably rigid material such as a polymer. Reset spring 338 may be a coil spring or other suitable type of spring.

In one or more embodiments, a piston area of the shaft 340 of the piston 334 is greater than about 12 $mm^2$. In one or more example embodiments, a diameter of the end of shaft 340 is about 4.6 mm or about 16 $mm^2$ of piston area. The reset spring 338 for the outlet valve 122 may include a spring rate of between about 0.28 N/mm, and about 0.42 N/mm. When the outlet valve 122 is fully opened, a displacement of about 1.25 mm or more may occur. A flow area of the outlet valve 122, when fully opened, may be greater than about 3 $mm^2$, and may be greater than about 4 $mm^2$ in some embodiments. A diameter of an outlet port 356 may be about 2.29 mm, for an outlet area of about 4.1 $mm^2$. Thus, as should be recognized, the outlet area of the outlet valve 122 may be smaller than the inlet area of the inlet valve 120, such as by a factor of at least 1.1. However, as will be appreciated by those of ordinary skill in the art, other outlet diameters, areas of the piston 334, and spring rates may be used and would be adjusted for larger or smaller breakers.

Pressure inside the expansion chamber 112 acting against the circular end area of the shaft 340 causes the piston 334 to translate in aperture 342 and against the spring biasing force provided by the reset spring 338. When the pressure in the arc chamber falls below a second outlet threshold pressure (the outlet threshold pressure 430) that is predesigned, the shaft 340 moves outwardly in the aperture 342 such that one or more outlet ports 350 are opened thus allowing gas (e.g., air and arcing gases) to escape and flow from the expansion chamber 112 and back into the arc chamber 102. Gas continues to flow into the arc chamber 102 until the pressure in the expansion chamber 112 nears equalizing with the pressure in the arc chamber 102. At this point, the force of the reset spring 338 between the mount 332 and the flange 346 recloses the outlet valve 122 by moving the one or more outlet ports 350 back into the aperture 342.

Thus, all of the current falling phase 429 (FIG. 4), the inlet valve 120 may remain closed, and between the peak pressure 454 and the outlet threshold pressure 430, outlet valve 122 may also remain closed. Effectively, once the outlet valve 122 opens, the expansion chamber 112 begins to expel gas flow into the arc chamber 102 at a relatively high volume rate, and in particular may expel a jet of gas into the arc chamber 102.

The gas jet flow rate may range between about 500 $mm^3$/ms and about 1,000 $mm^3$/ms in some embodiments. Other flow rates may be used. The jet of gas may be directed towards a position of the moveable electrical contact 104 such that the jet of gas 152 may impinge (as indicated by arrow) on the moveable electrical contact 104 when the moveable electrical contact 104 is in the tripped position as shown in FIG. 1A. The provision of the gas jet (e.g., jet of gas 152) is believed to increase the dielectric strength between the moveable electrical contact 104 and the stationary electrical contact 106. As a result, the recovery voltage is reduced or at least the propensity or magnitude of re-ignition is reduced.

In some embodiments, the inlet threshold pressure 426 and the outlet threshold pressure 430 should be made as low as practical, so that the expansion chamber 112 may be pressurized to the greatest extent practical and that the pressure differential may be the greatest to provide high flow rate gas jetting. In some embodiments, the inlet threshold pressure 426 may be greater than the outlet threshold pressure 430.

Referring now to FIG. 4, a graph illustrating an estimated relationship between pressure and time during a tripping event causing electrical contact separation in a circuit breaker 101 is shown. During the current rising phase 427, the pressure in the arc chamber 102 is higher than the pressure in the expansion chamber 112. Once the inlet threshold pressure 426 is met, gas flow is generated to push heated air and arcing gases into the expansion chamber 112. At some point during the rising current phase 427, the pressure in the expansion chamber 112 is built up to be approximately equal to the pressure in the arc chamber 102 wherein the inlet valve 120 closes.

After current in the arc during the half cycle reaches peak arc current and peak pressure at peak pressure 454, the pressure in the arc chamber 102 starts to fall. At a certain point in time during the current falling phase 429, the pressure in the arc chamber 102 will fall to the point where the pressure differential between the expansion chamber 112 and the arc chamber 102 is great enough to open the outlet valve 122. This point is referred to as the outlet threshold pressure 430. As this point, the outlet valve 122 opens and gas flow is generated that blows a jet of gas from the expansion chamber 112 into the arc chamber 102 at relatively high velocity.

According to one or more embodiments, a volume of the expansion chamber and the size of the outlet port of the outlet valve 122 may be selected such that the gas flow from the expansion chamber 112 may last until the current flow in the arc approximately reaches the natural zero crossing 455.

Figure 5A:
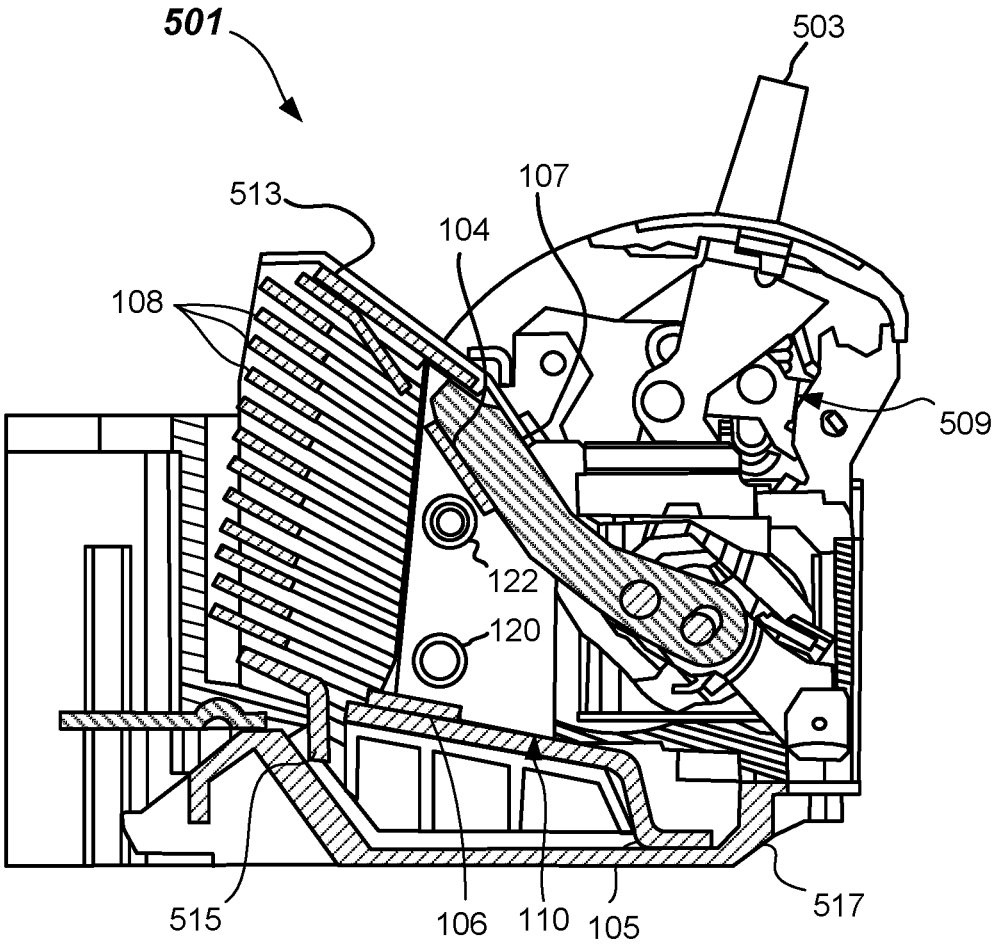
FIG. 5A illustrates a cross-sectional side view of a circuit breaker with one or more expansion chambers in accordance with one or more embodiments.
Figure 5B:
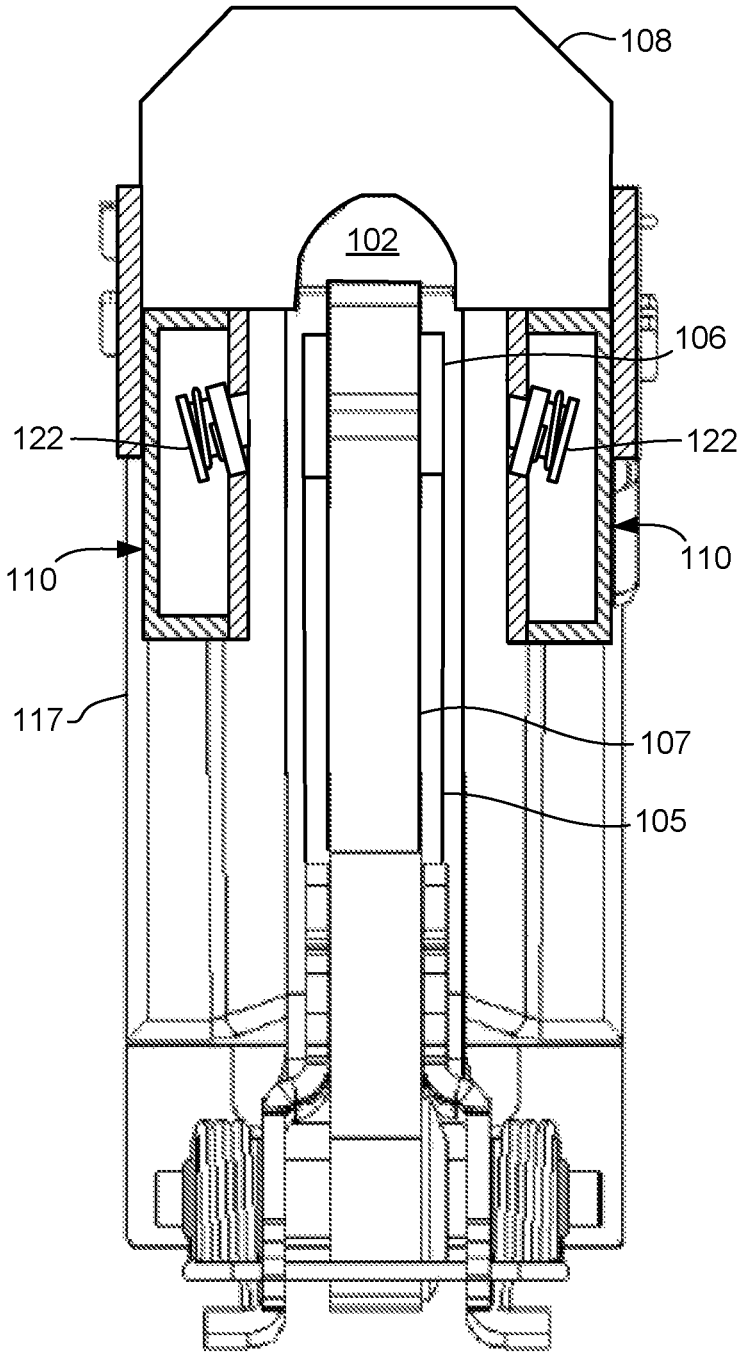
FIG. 5B illustrates a cross-sectional top view of a circuit breaker with one or more expansion chambers in accordance with one or more embodiments.

FIGS. 5A and 5B illustrate an embodiment of a circuit breaker 501 that includes a molded case 517 that may be made up of a number of interconnecting case sections held together by fasteners (e.g., rivets or the like) and may include an arrangement of internal and external walls, which are adapted to contain or retain various components of the circuit breaker 501. While the circuit breaker 501 illustrated is a molded case circuit breaker (MCCB) it will be appreciated by those of ordinary skill in the art that the present invention is applicable to other designs with similar constructions.

In the depicted example embodiment, the circuit breaker 501 includes a handle 503 that is operably connected to an operating mechanism 509. The operating mechanism 509 may be interconnected to the contact arm 107 that includes the moveable electrical contact 104, and may cause tripping of the contact arm 107 (e.g., manually, or due to a short circuit, persistent overcurrent, or an arc or ground fault, for example). Operating mechanism 509 may include conventional components such as cradle, armature, and spring, the details of which are entirely conventional and will not be further explained herein. The circuit breaker 501 may further include an upper arc runner 513 and a lower arc runner 515, and a plurality of arc plates 108 that are stacked and spaced vertically as shown. As best illustrated by FIG. 1B and FIG. 5B, the arc plates 108 may have a u-shape and are disposed around the front portion of the arc chamber 102 containing the stationary electrical contact 106 and the moveable electrical contact 104 (FIG. 5A). In the depicted embodiment, two expansion members 110 are shown each including inlet valve 120 and outlet valve 122. However, only one expansion member 110 may be provided in some embodiments.

Figure 6:
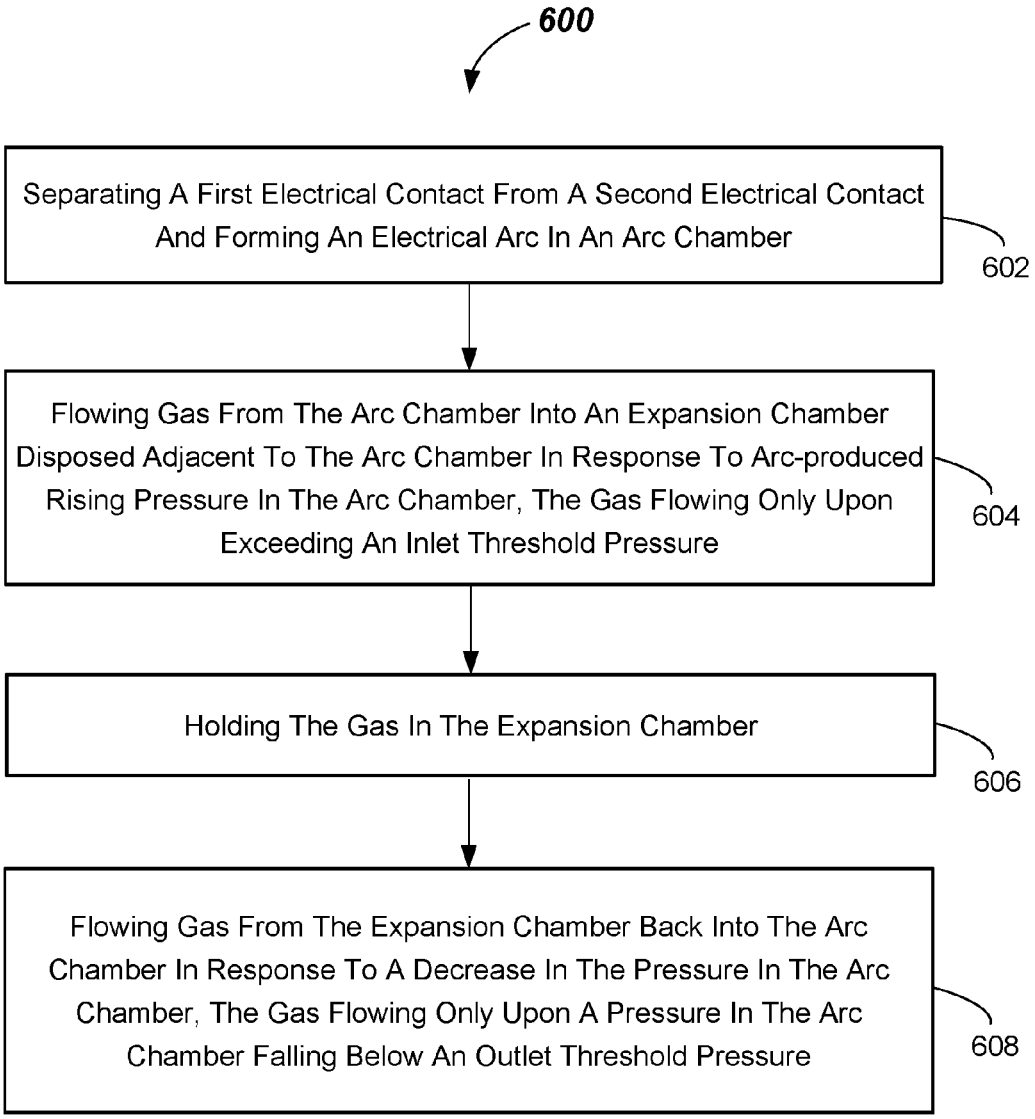
FIG. 6 illustrates a flowchart of a method of operating a circuit breaker in accordance with one or more embodiments.

FIG. 6 illustrates a method of operating a circuit breaker (e.g., circuit breaker 501) including expansion chambers 112 in accordance with one or more embodiments of the present invention. The method 600 includes, in 602, separating a first electrical contact (e.g., moveable electrical contact 104) from a second electrical contact (e.g., stationary electrical contact 106) and forming an electrical arc in an arc chamber (e.g., arc chamber 102), and, in 604, flowing gas (e.g., air and arcing gasses) from the arc chamber (e.g., arc chamber 102) into an expansion chamber (e.g., expansion chamber 112) disposed adjacent to the arc chamber in response to arc-produced rising pressure in the arc chamber, wherein the gas flows only upon exceeding an inlet threshold pressure (e.g., inlet threshold pressure 426—see FIG. 4).

The method 600 further includes, in 606, holding the gas in the expansion chamber for a time, and then, in 608, flowing gas from the expansion chamber (e.g., expansion chamber 112) back into the arc chamber (e.g., arc chamber 102) in response to a decrease in the pressure in the arc chamber. The gasses will flow only upon a pressure in the arc chamber falling below an outlet threshold pressure (e.g., outlet threshold pressure 430). This gas flow minimizes or prevents re-ignition. In one or more embodiments, the outlet valve 122 is oriented at an angled orientation to the arc chamber 102 such that the gas jet initiated by flowing the gas from the expansion chamber 112 impinges directly onto the moveable electrical contact 104 when the moveable electrical contact 104 is in the tripped position (as is shown in FIG. 1A). Other orientations of the inlet valve 120 and outlet valve 122, as well as configurations of the valves may be used.

While the invention is susceptible to various modifications and alternative forms, specific apparatus and methods embodiments have been shown by way of example in the drawings and are described in detail herein. It should be understood, however, that it is not intended to limit the invention to the particular apparatus or methods disclosed, but, to the contrary, the intention is to cover all modifications, equivalents and alternatives falling within the scope of the invention.

What is claimed is:

1. A circuit breaker, comprising:

first and second electrical contacts, the electrical contacts configured to generate an electrical arc upon being separated;

an arc chamber surrounding at least a portion of a space between the first and second electric contacts;

at least one expansion chamber positioned proximate to the arc chamber; and a valve assembly configured to allow threshold-based flow into and out of the at least one expansion chamber, wherein the valve assembly comprises an inlet valve configured to allow one-way inflow and an outlet valve configured to allow one-way outflow such that the outlet valve is different than the inlet valve, wherein the outlet valve is oriented at an angled orientation to the arc chamber to produce a gas jet that impinges directly onto a moveable electrical contact when the moveable electrical contact is in a tripped position, wherein the outlet valve comprises a bearing, a piston moveable relative to the bearing, and a reset spring coupled to the piston, wherein the piston includes a shaft that is closely and slidably received in an aperture of the bearing, wherein when a pressure in the arc chamber falls below an outlet threshold pressure, the shaft moves outwardly in the aperture such that one or more outlet ports in the shaft are opened, and wherein when a pressure in the at least one expansion chamber nears equalizing with the pressure in the arc chamber a force of the reset spring recloses the outlet valve by moving the one or more outlet ports back into the aperture.

2. The circuit breaker of claim 1, wherein valve assembly includes the inlet valve configured to open at an inlet threshold pressure.

3. The circuit breaker of claim 1, wherein valve assembly includes the outlet valve configured to open at an outlet threshold pressure.

4. The circuit breaker of claim 1, wherein the valve assembly includes the inlet valve configured to open at an inlet threshold pressure and the outlet valve configured to open at an outlet threshold pressure.

5. The circuit breaker of claim 4, wherein the inlet threshold pressure is greater than the outlet threshold pressure.

6. The circuit breaker of claim 1, comprising a first expansion chamber that includes a volume of greater than 500 $mm^3$.

7. The circuit breaker of claim 1, comprising a second expansion chamber that includes a volume of greater than 500 $mm^3$.

8. The circuit breaker of claim 1, wherein the at least one expansion chamber comprises a first expansion chamber and a second expansion chamber opposite the first expansion chamber across the arc chamber.

9. The circuit breaker of claim 1, wherein the inlet valve comprises a bearing, a piston moveable relative to the bearing, and a reset spring coupled to the piston to spring bias the piston to a normally closed position.

10. The circuit breaker of claim 1, wherein the inlet valve comprises a bearing and a piston configured to open relative to the bearing upon exceeding an inlet threshold pressure.

11. The circuit breaker of claim 1, wherein the reset spring is coupled to the piston to spring bias the piston to a normally closed position.

12. The circuit breaker of claim 1, wherein the piston is configured to open relative to the bearing upon exceeding the outlet threshold pressure.

13. The circuit breaker of claim 1, wherein the inlet valve is positioned at a bottom of the expansion chamber, and the outlet valve is positioned at a top of the expansion chamber.

14. The circuit breaker of claim 1, wherein the inlet valve includes an inlet flow area of greater than about 5 $mm^2$.

15. The circuit breaker of claim 1, wherein the outlet valve includes an outlet flow area of greater than about 3 $mm^2$.

16. The circuit breaker of claim 1, wherein an outlet flow area of the outlet valve is less than an inlet flow area of the inlet valve.

17. An arc pressure control assembly, comprising:

an arc chamber containing first and second electrical contacts;

at least one expansion chamber positioned proximate to the arc chamber; and a valve assembly configured to allow threshold-based flow into and out of the at least one expansion chamber, wherein the valve assembly comprises an inlet valve configured to allow one-way inflow and an outlet valve configured to allow one-way outflow such that the outlet valve is different than the inlet valve, wherein the outlet valve is oriented at an angled orientation to the arc chamber to produce a gas jet that impinges directly onto a moveable electrical contact when the moveable electrical contact is in a tripped position, wherein the outlet valve comprises a bearing, a piston moveable relative to the bearing, and a reset spring coupled to the piston, wherein the piston includes a shaft that is closely and slidably received in an aperture of the bearing, wherein when a pressure in the arc chamber falls below an outlet threshold pressure, the shaft moves outwardly in the aperture such that one or more outlet ports in the shaft are opened, and wherein when a pressure in the at least one expansion chamber nears equalizing with the pressure in the arc chamber a force of the reset spring recloses the outlet valve by moving the one or more outlet ports back into the aperture.

18. A method of operating a circuit breaker, comprising:

separating a first electrical contact from a second electrical contact and forming an electrical arc in an arc chamber;

flowing gas from the arc chamber into an expansion chamber disposed adjacent to the arc chamber in response to arc-produced rising pressure in the arc chamber, the gas flowing only upon exceeding an inlet threshold pressure;

holding gas in the expansion chamber;

flowing gas from the expansion chamber back into the arc chamber in response to a decrease in the pressure in the arc chamber, the gas flowing only upon the pressure in the arc chamber falling below an outlet threshold pressure; and providing a valve assembly configured to allow threshold-based flow into and out of the expansion chamber, wherein the valve assembly comprises an inlet valve configured to allow one-way inflow and an outlet valve configured to allow one-way outflow such that the outlet valve is different than the inlet valve, wherein the outlet valve is oriented at an angled orientation to the arc chamber to produce a gas jet that impinges directly onto a moveable electrical contact when the moveable electrical contact is in a tripped position, wherein the outlet valve comprises a bearing, a piston moveable relative to the bearing, and a reset spring coupled to the piston, wherein the piston includes a shaft that is closely and slidably received in an aperture of the bearing, wherein when the pressure in the arc chamber falls below the outlet threshold pressure, the shaft moves outwardly in the aperture such that one or more outlet ports in the shaft are opened, and wherein when a pressure in the at least one expansion chamber nears equalizing with the pressure in the arc chamber a force of the reset spring recloses the outlet valve by moving the one or more outlet ports back into the aperture.

* * * * *